US007784312B2

(12) United States Patent
Hedegaard

(10) Patent No.: US 7,784,312 B2
(45) Date of Patent: Aug. 31, 2010

(54) DEVICE FOR PERFORMING COMPLETE- OR PARTIAL EMPTYING/FILLING OF A DRYING AGGREGATE WITH UPSTANDING EXPANSION PELT BOARDS

(75) Inventor: Jens Hedegaard, Holstebro (DK)

(73) Assignee: Dansk Mink Papir A/S, Holstebro (DK)

( * ) Notice: Subject to any disclaimer, the term of this patent is extended or adjusted under 35 U.S.C. 154(b) by 0 days.

(21) Appl. No.: 12/162,078

(22) PCT Filed: Jan. 23, 2007

(86) PCT No.: PCT/DK2007/050009

§ 371 (c)(1),
(2), (4) Date: Jul. 24, 2008

(87) PCT Pub. No.: WO2007/085269

PCT Pub. Date: Aug. 2, 2007

(65) Prior Publication Data

US 2009/0007604 A1 Jan. 8, 2009

(30) Foreign Application Priority Data

Jan. 24, 2006 (DK) ..... 2006 00102

(51) Int. Cl.
*C14B 1/26* (2006.01)

(52) U.S. Cl. ..... 69/19

(58) Field of Classification Search ..... 69/19, 69/19.1; 57/266–275

See application file for complete search history.

(56) References Cited

U.S. PATENT DOCUMENTS 6,250,059 B1 * 6/2001 Teich ..... 57/281

FOREIGN PATENT DOCUMENTS

WO 2005/026394 A1 3/2005

* cited by examiner

*Primary Examiner*—Shaun R Hurley
(74) *Attorney, Agent, or Firm*—Roberts Mlotkowski Safran & Cole, P.C.; David S. Safran

(57) ABSTRACT

In connection with the various working operations in the production of furs, a not inconsiderable amount of manual labor is involved in the handling of the pelt boards or expansion pelt boards between the various work processes. To make the production of furs more profitable, manual labor is reduced to a minimum using a device for performing a complete or partial emptying/filling of a drying aggregate for upstanding expansion pelt boards, with or without tanned, or tanned and dried pelts, to one or more suitable receiving stations for further transport and/or handling. The device has a gripping element which can be activated for displacement, the movements of which are controlled by a control unit so that upstanding expansion pelt boards with or without tanned, dried pelts, are transferred automatically in upstanding position from the surface of the drying aggregate to a receiving point for further handling and transport.

10 Claims, 8 Drawing Sheets

DEVICE FOR PERFORMING COMPLETE- OR PARTIAL EMPTYING/FILLING OF A DRYING AGGREGATE WITH UPSTANDING EXPANSION PELT BOARDS

BACKGROUND OF THE INVENTION

1. Field of Invention

The present invention relates to a device for performing a complete or partial emptying/filling of a drying aggregate with upstanding expansion pelt boards, with or without tanned pelts, or tanned and dried pelts, to one or more suitable receiving places for further transport and/or processing.

2. Description of Related Art

A drying aggregate and an expandable and collapsible distension element/pelt board, in the following also referred to as expansion pelt boards, are disclosed in International Patent Application WO 2005/026394. The expansion board can be described as a distension element/pelt board which has a longitudinal axis, a first transverse axis (breadth axis) and a second transverse axis (height axis), a front end for engaging the nose end of a pelt, and a foot end which is preferably terminated at right-angles in relation to the longitudinal axis of the board, and where the distension element/the board has at least a first and a second convex surface with an open structure which defines a cavity, and where said surfaces of the board are configured in a substantially symmetrical manner around at least two of the defined axes, and where the board comprises at least one opening to the cavity in the foot end. The distension element/board typically consists in practice of two elongated half-shells with convex surfaces with open structure, which in combination with a displaceable locking and distension element in the board's longitudinal direction form a cavity from which the air under the open structure can be changed via an opening in the foot end during the drying process.

The convex configuration of the surface of the distension element in combination with its open structure has the result that the fastening of a pelt stretched on the distension element/pelt board of the type described here can be established by a holding bag or by wrapping, which after the pelt is stretched on the board is drawn over the fur side of the pelt and drawn towards the foot end of the board, so that at relevant areas of the pelt board the bag applies pressure which presses the leather side of the pelt against the convex open structures, whereby sufficient friction is created to enable the pelt to be fastened in the stretched position during the whole of the subsequent drying procedure. The use of staples and other pelt-damaging holding means is hereby rendered superfluous, which means that the price for pelts dried on the newly-developed pelt boards is higher, with subsequent economic benefits for the seller.

The displaceable locking and distension element is displaceable between a forward position, where the distension element has its greatest circumference, and is the position in which the locking and distension element are in during the tanning and drying of pelts, and a drawn-back position where the expansion pelt board is "collapsed", so that the facing edges of the expansion board are in contact with each other. This results in a reduction of the expansion board's circumference, which is a very great advantage when the pelt shall subsequently be removed from the board, in that the work of pulling the pelt free from the surfaces of the board is considerably reduced, whereby the dried pelt is easy to remove.

In the removal of the pelt from the board, there is thus effected a displacement of the locking and distension element to the drawn-back position, whereby the expansion pelt board "collapses" with a subsequent smaller reduction in the circumference of the board, whereby the work of pulling the dried pelt from the collapsed expansion board is eased to a significant degree, as compared with the pulling-free of a dried pelt from a conventional pelt board.

The expansion board's locking and distension element also comprises a blunt part extending from the foot end of the distension element/pelt board, and which herewith provides an engagement area for holding means and the like which are used in connection with the fastening and handling of the expansion board in a drying aggregate arranged for this purpose (more about this in the following), and in connection with the displacement of the locking and distension element between the drawn-back position and the forward position and vice versa.

With the object of being able to remove possible fat on the leather side of the pelt during the drying process, a layer of fat-absorbing material can in certain cases be placed between the convex open-structured surface of the board, which material is placed on the board before the drawing-over of the pelt. This material can typically be a bag made of fat-absorbing material, chiefly fat-absorbing paper with perforations, for example, in the form of a so-called pelt board inner bag, which will thus be lying between the surface of the board and the leather side of the pelt.

The subsequent drying of the pelt takes place in a drying aggregate comprising a carriage, the bed of which is built up as an air induction channel with a blower, where the upwardly-facing side surface comprises openings for accommodation of the blunt extending part on the locking and distension element, which is extending from the foot end of the expansion board with the tanned pelt, which is inserted into the drying unit for drying. The drying then takes place by placing the drying unit in a room with conditioned air, where the blower is activated, whereby a continuous exchanging of the air in the expansion board's cavity is effected via the air induction openings in the immediate vicinity of the openings for receiving the blunt extending parts on the locking and distension elements. The expansion pelt boards are placed and fastened in the drying unit in the upright position.

In addition to the advantages already mentioned, the expansion boards have the advantage that the handling of the pelt boards after the drying of the pelts is relatively limited, in that after the pelts have been mounted on the expansion pelt boards, these are transferred directly to the drying unit, after which this can be placed in the drying room with the desired air temperature and humidity, and the blowing of air into the cavities in the boards can commence by activation of the drying unit's blower. The pelts are thus dried on the boards, which as described earlier are placed standing upright from the bed of the drying unit, and after the drying the boards are conveyed for removal of the boards from the unit.

The expansion pelt board typically appears in two configurations, a first configuration, which is intended for use in the mounting and drying of pelts from male animals, is elongated in fashion, and the extent of the board in relation to the longitudinal axis in the direction of the first transverse axis and the second transverse axis is more or less uniformly decreasing in the direction towards the front end, which is pointed but rounded-off, extending from an area of the expansion element near the foot end, where the extent of this around the first and the second transverse axis is more or less constant. Such a pelt board is thus referred to as a "male pelt board".

Expansion pelt boards intended for use in the mounting and drying of pelts from female animals are of a second configuration, but have the same fashion as those described above for male animals except that they are shorter, in that the boards for pelts from female animals do not comprise the area near the foot end, where the extent of this around the first and the second transverse axes is more or less constant. Such a board is thus referred to as a "female pelt board".

In the following, the "tanning" of a pelt is to be understood as a process consisting of the following: the mounting of a pelt on the board, chiefly with the leather side of the pelt facing towards the surface of the board, the stretching of the pelt on the board, and the fastening of the pelt in the stretched position on the board with the use of one or more types of holding means.

In the following, no distinction is made between the above-mentioned two types of pelt boards unless specific attention is drawn to the difference.

In the following, a "tanned" pelt shall be understood to be a pelt drawn on to the pelt board, stretched on the board and fastened in this position by one or more holding means.

The term "drying procedure" or drying of the pelt shall be understood to be a drying of the leather side of the pelt to a preferred degree whereby attack by mites is known from experience to be excluded. The drying procedure is typically carried out by a continuous changing of the air in the cavity in the board by the blowing-in of dry air. In the following, the "removal" of a pelt shall be understood to be the removing of a pelt which has been mounted, stretched and fastened in this position on the board during the drying procedure, typically after the pelt drying process has been concluded. The removal procedure also comprises the removal of any means which have been used for fastening the pelt in the stretched position on the pelt board.

The expansion pelt boards are developed to be able to be used a great number of times, and with the improved drying characteristics which are offered by these boards, the boards will be reused up to several times during the course of a pelt processing period.

When the dried pelt and the holding bag and pelt board inner bag have been removed, the pelt board is thus ready for reuse, but before a new pelt is mounted on the board for stretching (tanning), it will be necessary to provide the board with a new inner bag so that the possibility is hereby provided for the removal of fat from the leather side of the pelt during the drying.

Machines and devices have been developed for the mechanical mounting of pelt board inner bags, the mounting, stretching and fastening of pelts on expansion boards, and for the removal of the dried pelts from the expansion boards, which has resulted in a not inconsiderable saving of manual labor and herewith a better profitability in connection with the production of furs.

However, there remains a need for an automatic handling of the expansion boards in upright position between the drying aggregate and the means for the conveying of these respectively to the pelt remover, the arrangement for the mounting of board inner bags, the tanning machine, and back to the drying aggregate.

SUMMARY OF THE INVENTION

In view of the foregoing, it is the object of the present invention to provide an arrangement of the kind disclosed which will render superfluous the use of manual labor for this purpose.

This object is achieved with a device of the kind disclosed by way of introduction, and which is characterized in that it comprises a first actuator which is vertically displaceable between an upper and a lower end position, by a second actuator, and a gripping element cooperating with a relevant upstanding expansion board, that comprises a first fixed part and a second displaceable part cooperating with the first fixed part, connected to the second actuator which is mounted in the free end of a support arm displaceable by a third actuator, where the support arm is housed on a carriage which is displaceable on a guide rail by a fourth actuator.

There is hereby provided an arrangement which is able to perform the emptying and filling of a drying aggregate for expansion boards in an upstanding position, with or without pelts, and to transfer the boards to relevant transport means, storage means or transfer means with suitable receiving facilities for them, and to implement transfer of them from the transport, storage or transfer means back to the drying aggregate. An actual expansion pelt board placed on a drying aggregate is thus transferred from it to a desired location by the gripping element being positioned in the preferred position of engagement in front of the expansion board, after which the gripping element is fed forwards so that the board is disposed between the facing sides of the gripping element's fixed and moveable parts, after which the second actuator is activated, whereby the expansion board is now secured in the gripping element. Thereafter, the gripping element is raised by activation of the first actuator, so that the blunt extending part of the expansion board's distension element is free of the bed of the drying aggregate. The gripping element is then displaced by activation of the third and fourth actuators to a suitable place of delivery comprising an opening for receiving the blunt extending part of the expansion board's distension element, after which the first actuator is activated for the carrying out of a lowering of the gripping element so that the blunt extending part of the expansion board is engaged in the opening, after which the second actuator is activated for the opening of the gripping element, whereby the now transferred expansion board is released, and by activation of the third and the fourth actuators, the fixed and moveable parts of the gripping element are then moved back for the collection of a further pelt board, and the operation is repeated until the aggregate is stopped or is reset due to a lack of supply of expansion boards.

Out of regard for the processes to which the expansion boards are to be subsequently subjected, it can sometimes be expedient for the expansion boards to be turned at an angle before they are placed in the transport, storage or transfer means, or where they are collected from them by the arrangement for transfer back to and placing in the drying aggregate. With the object of ensuring an expedient handling and angular turning, the gripping element can be pivotally mounted around a substantially vertical axis for the free end of the support arm, and which by a fifth actuator can be pivoted between a first collection/delivery position and a second collection/delivery position turned at an angle in relation to the first position.

With the object of ensuring an ideal working height for the device, the guide rail can be housed on brackets placed on a fast under layer. In this connection it will be obvious that the height of the brackets shall be determined so that an ideal working height is achieved for the device in relation to the height of the bed of the drying aggregate, and the height of the transport, storage or transfer means, so that the operations with the gripping element are optimized.

With the object of ensuring a fastening of a relevant drying aggregate in a preferred position during the emptying and/or filling with the upstanding expansion boards, at least one of the brackets can comprise a first part of a locking mechanism which can be activated by a sixth actuator, and which cooperates with a second part of the locking mechanism placed on a drying aggregate mounted on wheels for correct positioning and fastening of the drying aggregate during removal or placing of the expansion boards on the drying aggregate's surface with the gripping element.

With the object of ensuring optimum control of the gripping element during the handling of the upstanding expansion boards with the gripping element, in connection with the first, second, third, fourth, fifth and sixth actuators there can be at least a corresponding number of scanning units/signaling elements which indicate the position hereof, the signals being transmitted to the unit's control unit.

With the object of ensuring optimal operation in connection with the operations with the gripping element, including ensuring that the gripping element is controlled most directly in an optimal cooperating gripping position for a relevant expansion board which is to be handled with the arrangement, the activatable gripping element can comprise a signal-generating detection unit for the detection of upstanding expansion boards placed in a drying aggregate which is fastened and positioned by the locking mechanism, the signals being transmitted to the unit's control unit.

For the execution of an optimal implementation of operations with the gripping element, they can comprise a control unit which is arranged for the control of the gripping element's movement and displacement during activation, from a given position of a drying aggregate, and with starting point in position signals received from the scanning units and signals from the detection unit, for the execution of a complete or partial emptying/filling of the drying aggregate's surface for upstanding expansion boards, with or without tanned pelts, or tanned, dried pelts, to one or more already arranged receiving points/transport, storage or transfer means, or from these and back to the drying aggregate within the gripping element's area of action.

Thus, there is provided an arrangement which is able to perform a fully automatic handling/transfer of expansion boards in upstanding position with or without tanned, or tanned, dried pelts, between the surface of a drying aggregate for expansion boards to one or more already arranged receiving points/transport, storage or transfer means, or from these and back to the drying aggregate within the gripping element's area of action.

In the following, the invention is explained in more detail with reference to the accompanying drawings.

DETAILED DESCRIPTION OF THE INVENTION

Figure 1:
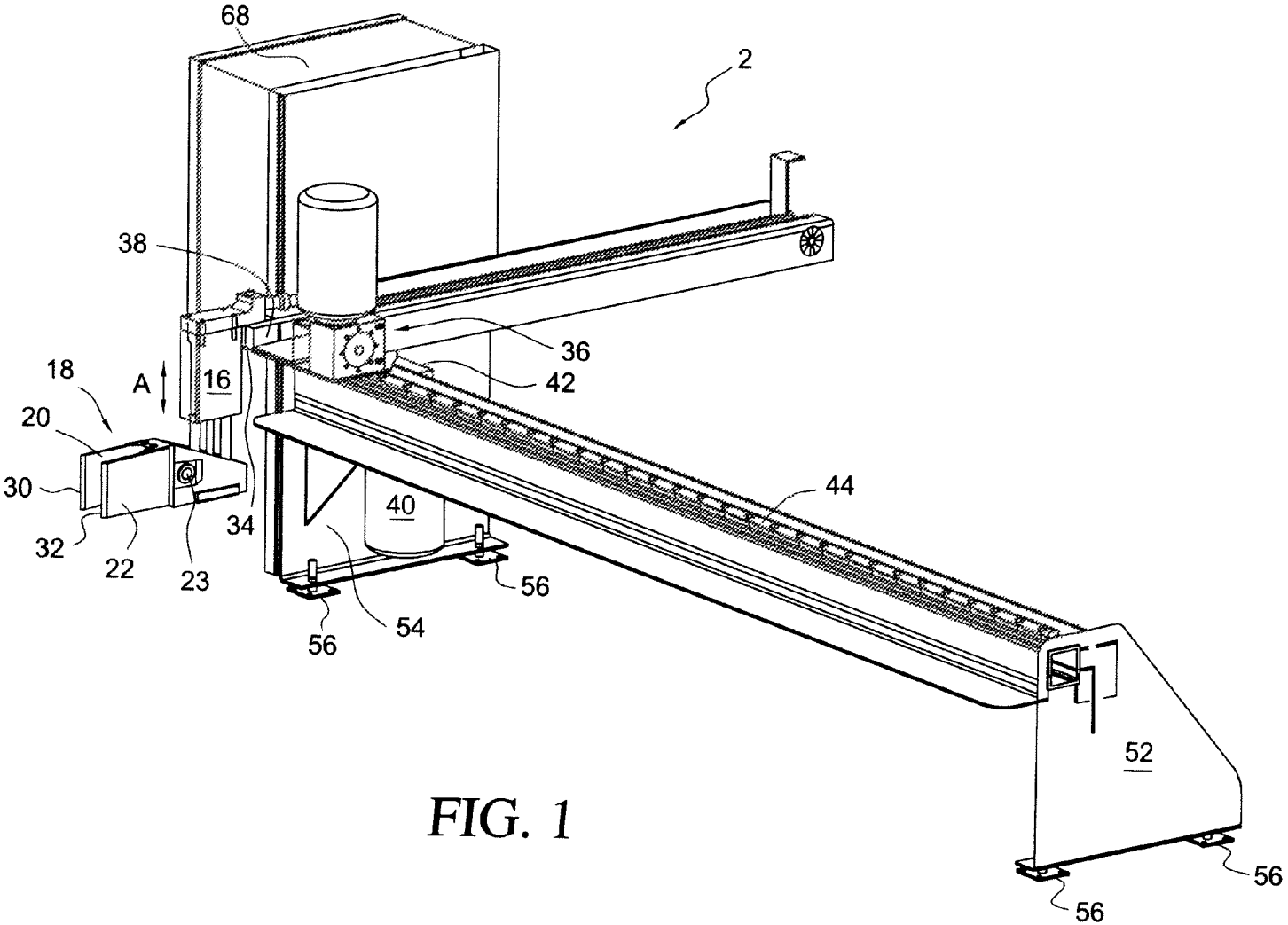
FIG. 1 is a perspective front view of a first embodiment of the device for performing a complete or partial emptying/filling of a drying aggregate according to the invention.
Figure 2:
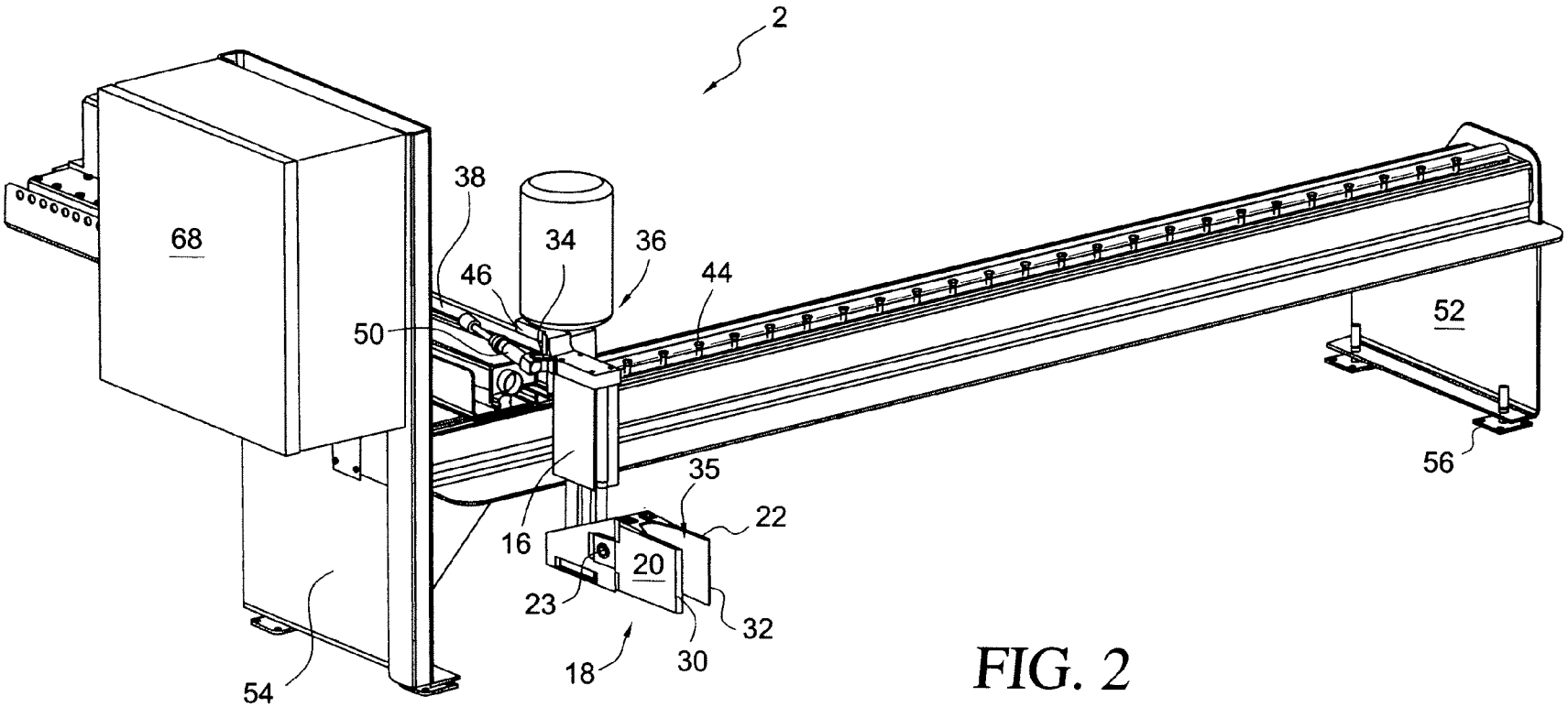
FIG. 2 shows the device of FIG. 1 from a different angle.
Figure 3:
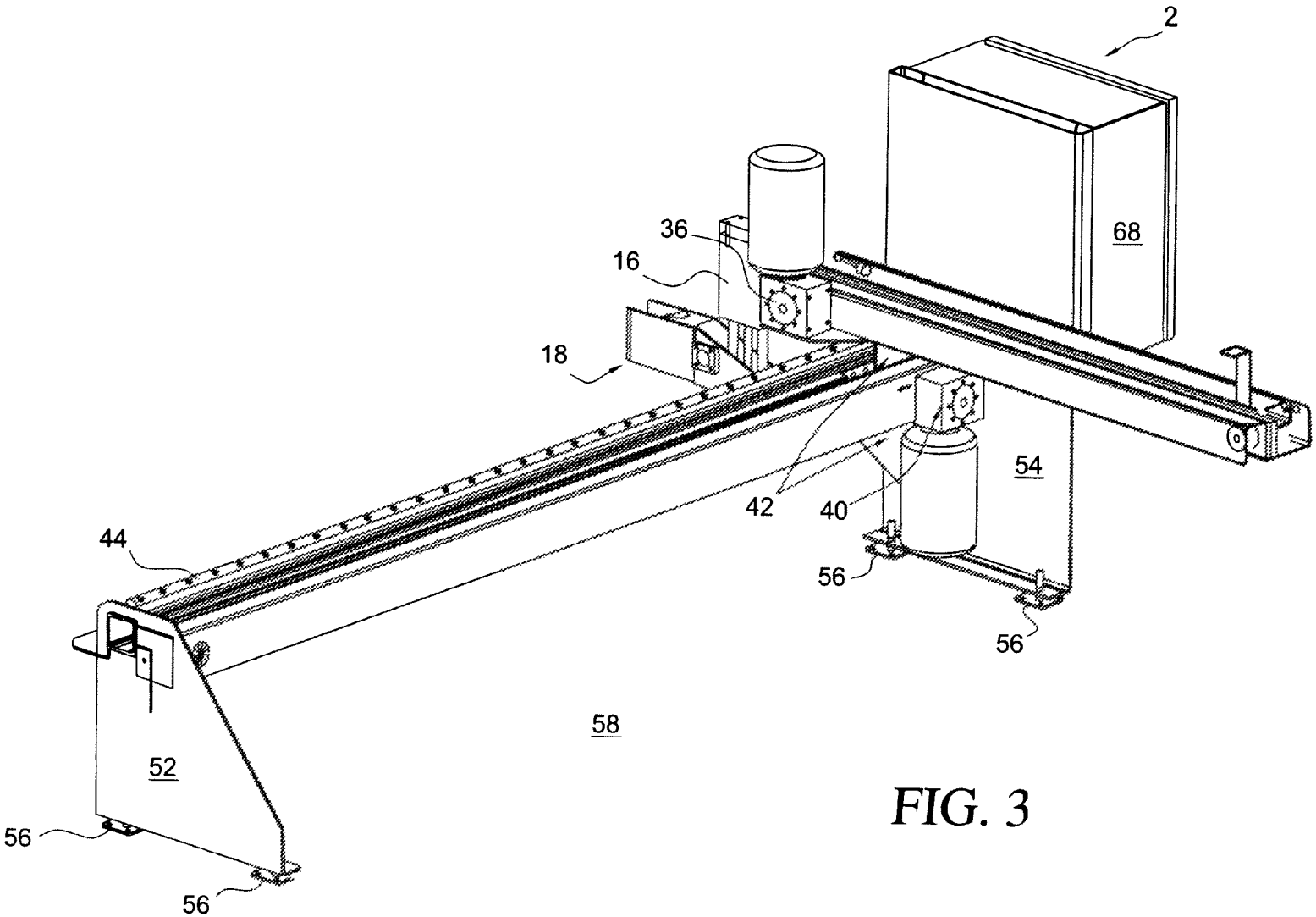
FIG. 3 is a perspective view of the device shown in FIG. 1 and FIG. 2, seen from the rear.

In FIGS. 1-3 there is shown a first embodiment of a device 2 for performing a complete or partial emptying/filling of a drying aggregate 4 (cf., FIG. 5) to/from one or more suitable receiving points 10, 12 (see, FIG. 5), 14 (see, FIG. 6) for further transport and/or handling, the drying aggregate 4 being of the kind which comprises an upwardly-facing surface 6 intended for the placing of a number of expansion boards in upstanding position, with upstanding expansion boards 8, with or without tanned pelts, or tanned and dried pelts.

Figure 4:
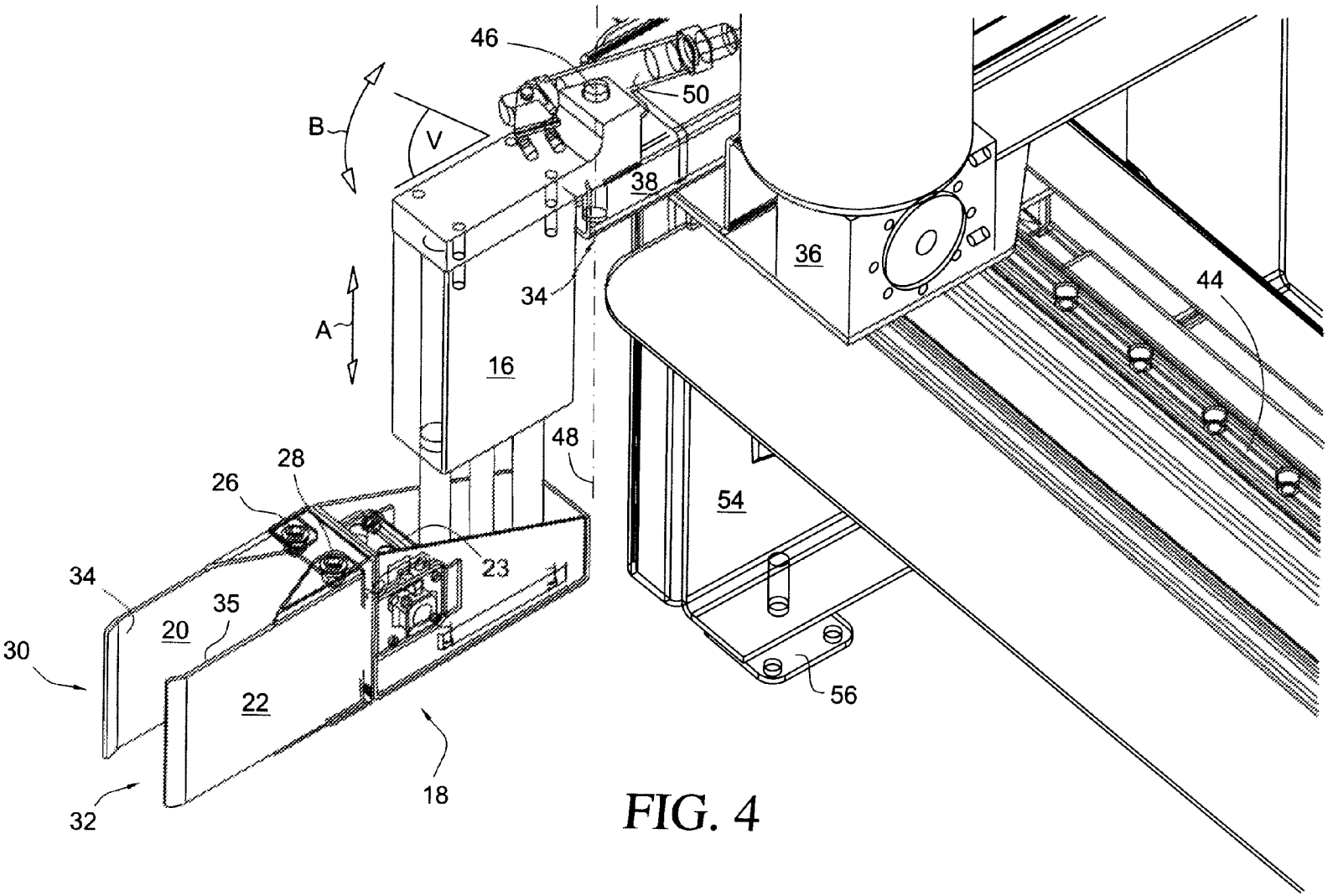
FIG. 4 is detailed perspective view of a gripping element comprised by the device shown in FIGS. 1-3 for performing a complete or partial emptying/filling of a drying aggregate according to the invention.

The device 2 comprises a gripping element 18 vertically displaceable by a first actuator 16, and which is hereby displaceable between two end positions, namely an upper and a lower position, as indicated by the arrow A in FIG. 1 and FIG. 4.

The gripping element 16 comprises a first plate-shaped movable part 20 and, cooperating herewith, a second plate-shaped movable part 22, each of which is pivotally mounted around its vertically-oriented pivot connection 26, 28 (FIG. 4). The free ends of the first and the second plate-shaped movable parts 20, 22 have flanges 30, 32 which are bent inwards towards the oppositely-facing sides 34, 35, so that there is thereby provided a better securing of a relevant expansion pelt board which is handled by the device according to the invention. On the opposite side of the pivot connections 26, 28, the plate-shaped movable parts 20, 22 are mutually connected at the ends opposite the bent-inward flanges 30, 32 by a second actuator 23, which can be activated so that the movable parts 20, 22 are displaceable towards each other in connection for the gripping of a respective expansion board 8, cf. FIG. 6, and away from each other so that a relevant expansion board 8 is released from the gripping element 18.

In the illustrated embodiment, the gripping element 18 is mounted on the free end 34 of a support arm 38 which is displaceable by a third actuator 37, the support arm 38 being mounted on a carriage 42 which is displaceable on a guide rail 44 by a fourth actuator 40 (FIGS. 1 & 3).

As can be seen in FIG. 2, and more clearly in FIG. 4, the first actuator 16, which supports the gripping element 18, is connected to the free end 34 of the support arm 38 by a pivot connection 46 with a substantially vertical axis 48, and by a fifth actuator 50, which is connected between the first actuator 16 the support arm 38, is pivotal between a first collection/delivery position and a second collection/delivery position which is turned at an angle in relation to the first position, such as is indicated by the arrow B and the angle v in FIG. 4.

Figure 5:
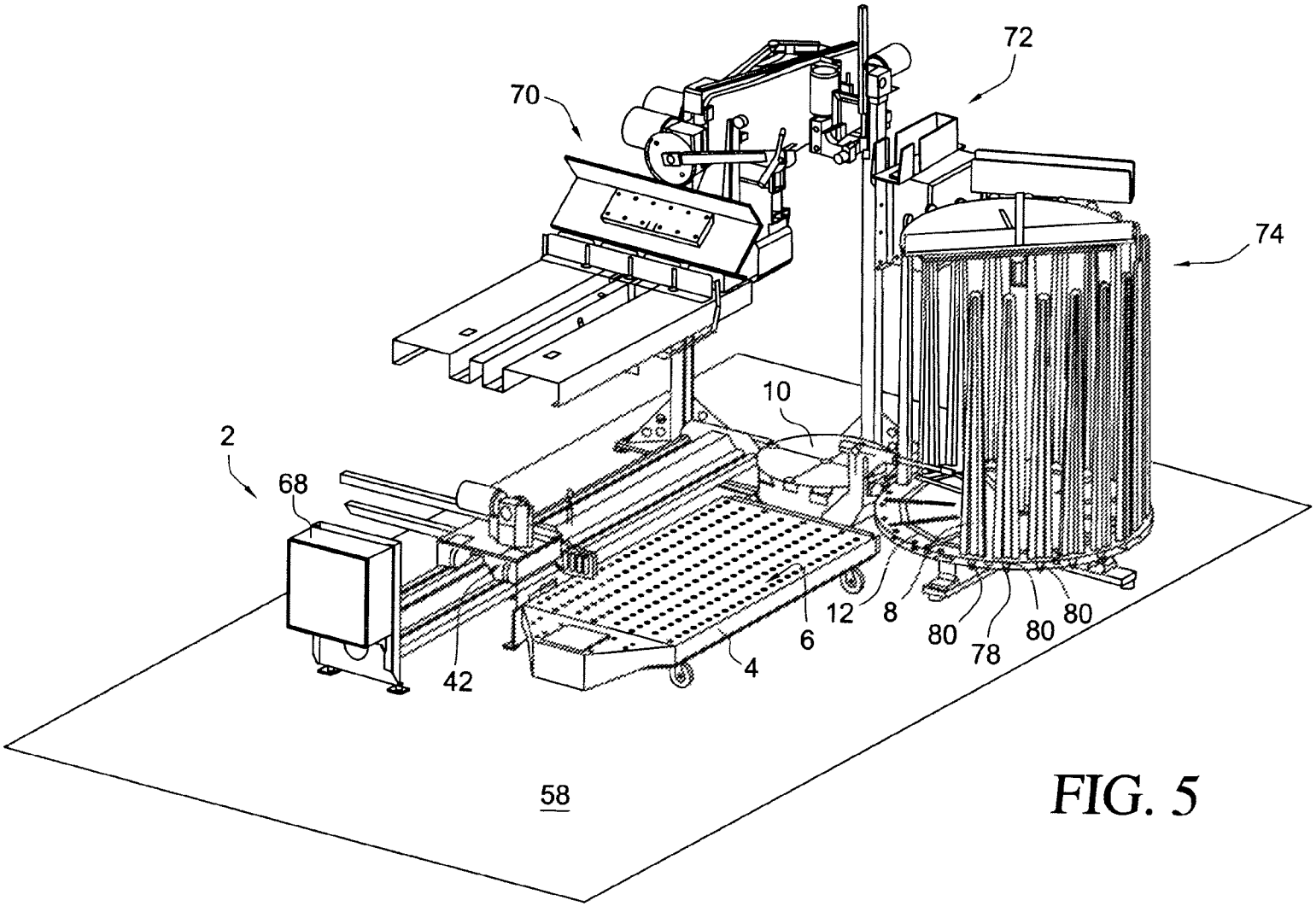
FIG. 5 is a perspective view showing the device for performing a complete or partial emptying/filling of a drying aggregate according to the invention, set up in an arrangement for the removal of pelts, mounting of pelt board inner bags etc.

In the illustrated embodiments of the device 2 according to the invention, the guide rail 44 is mounted on brackets 52, 54 which comprise height-adjustable foot-plates 56 intended for fastening in an underlayer 58, e.g., a floor (FIG. 5).

Figure 6:
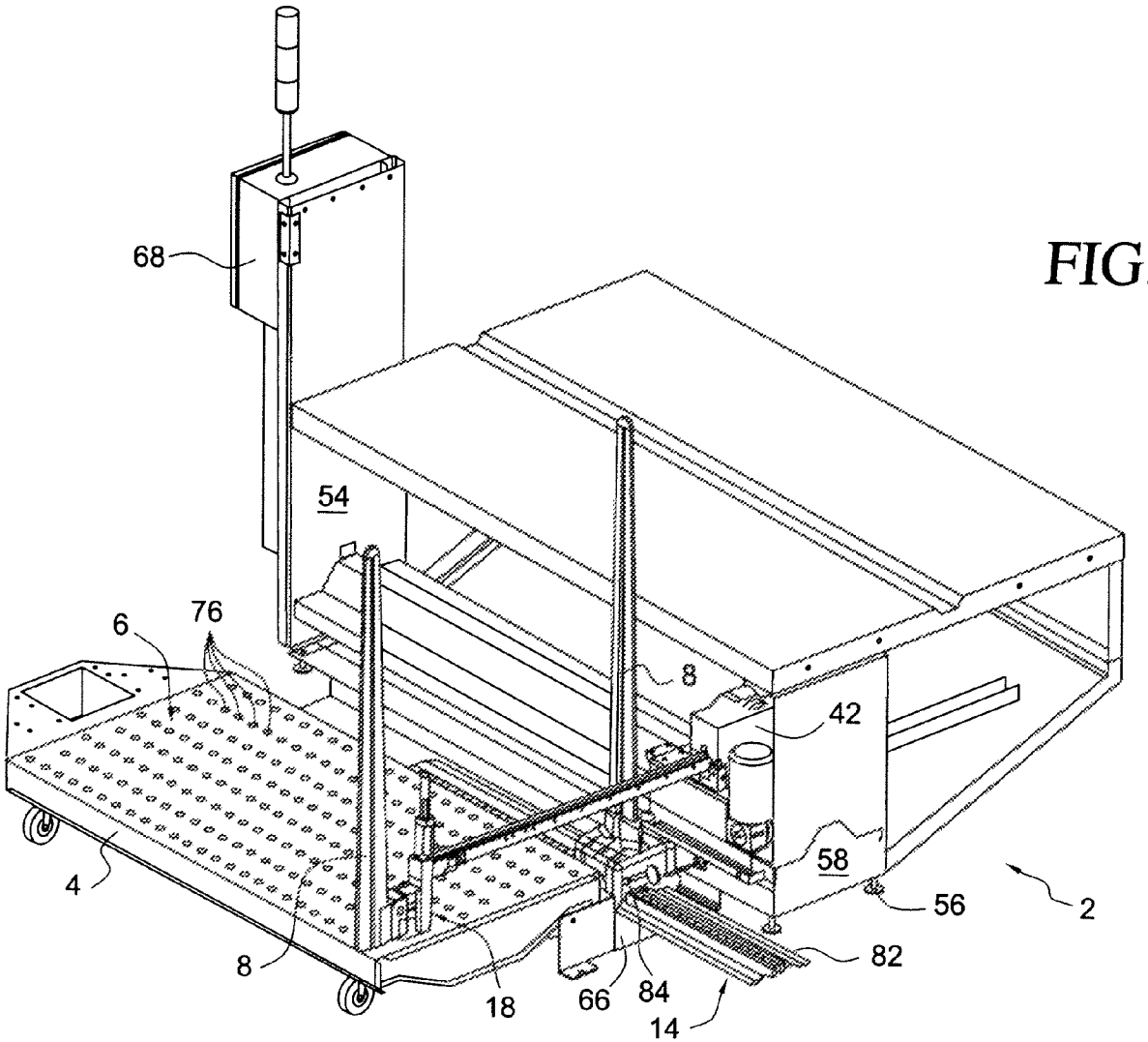
FIG. 6 is a perspective view of another embodiment of the device for performing a complete or partial emptying/filling of a drying aggregate according to the invention, where the device carries out the transfer of expansion boards between a drying aggregate and an internal transport system.
Figure 7:
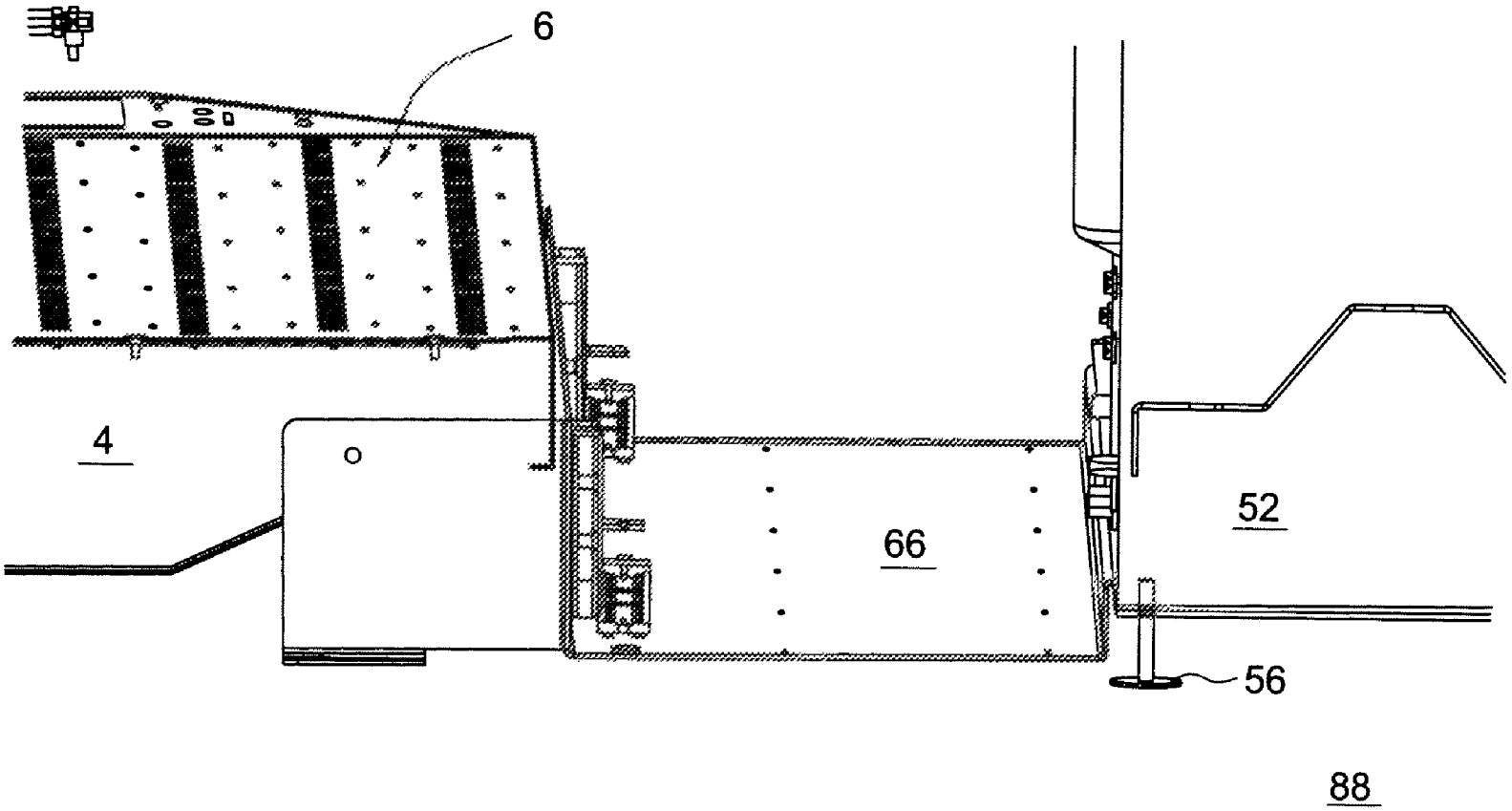
FIG. 7 is a detail view of the embodiment of the device according to the invention shown in FIG. 6, seen at an angle from above.
Figure 8:
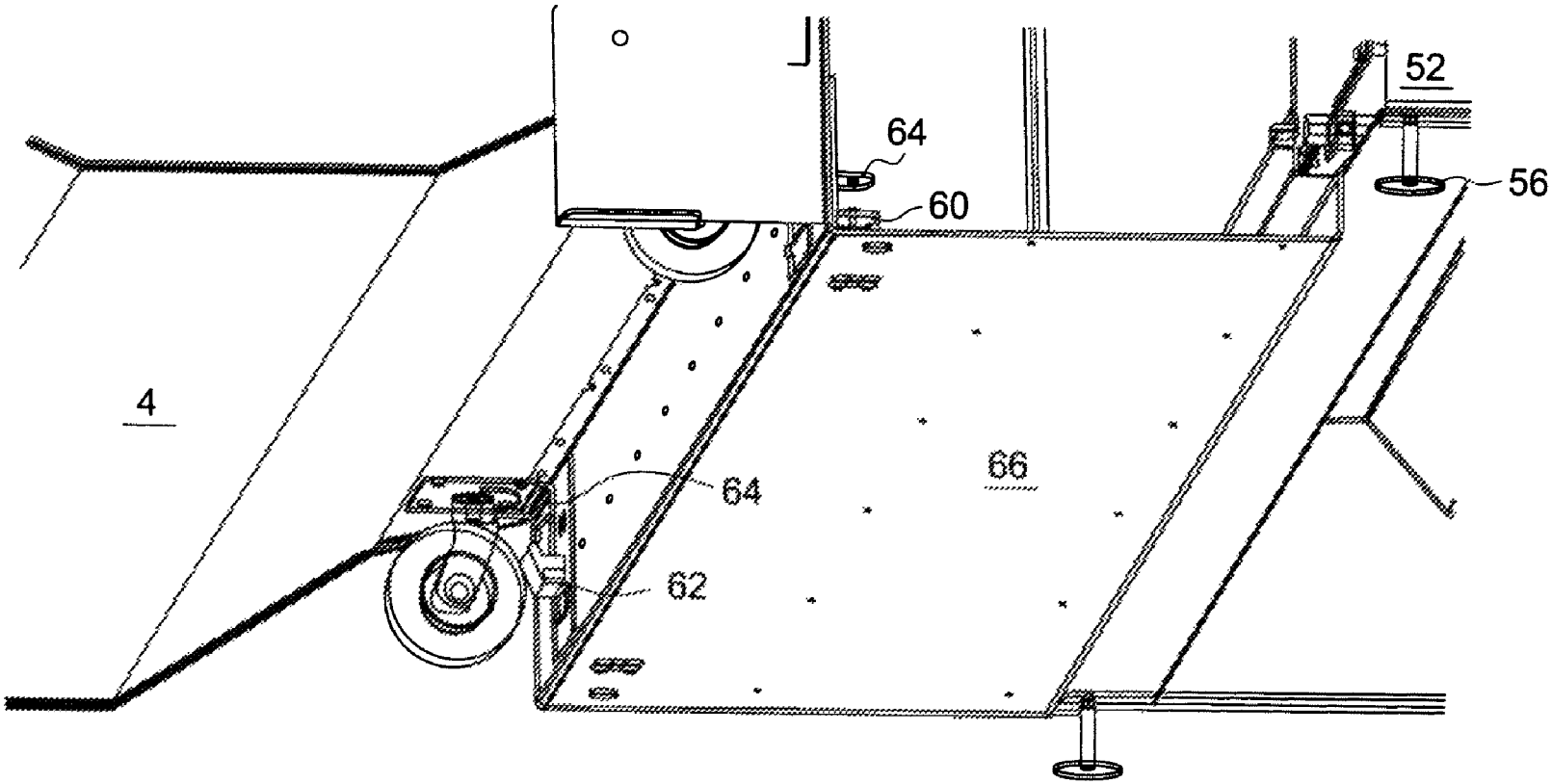
FIG. 8 is a detail view of the device according to the invention shown in FIG. 6, seen at an angle from below.

As can be seen from the embodiment shown in FIGS. 6-8, the device 2 also comprises two locking mechanisms, each of which comprises a first part of a locking mechanism 62 which can be activated by a sixth actuator 60, and which cooperates with a second part 64 which is placed on a wheel-mounted drying aggregate 4, as appears more clearly from FIGS. 7 & 8, which are detail views of relevant parts of the brackets 52 and the drying aggregate 4. The object herewith is to ensure a correct positioning and securing of the drying aggregate 4 during the removal or placing of the expansion boards 8 on the drying aggregate's surface 6 using the gripping element 18. The sixth actuator 60 and the first part of the locking mechanisms 62 are fastened to a profile-formed, plate-shaped part 66 which is connected with the brackets 52, 54.

In connection with the first, second, third, fourth, fifth sand sixth actuators 16, 23, 36, 40, 50, 60, the device 2 according to the invention also comprises at least a corresponding number of scanning units/signal generators which provide a readable signal for indicating the position of a respective actuator, the signals being transmitted to the device's control unit 68. In a specially preferred embodiment of the device 2 according to the invention, in association with the gripping element 18, there can also be provided a signal-generating detection unit (not shown) for the detection of upstanding expansion boards placed in a drying aggregate which is positioned and secured by the locking mechanism, said signals being transmitted to the device's control unit 68.

The control unit 68 is thus arranged for the control of the movements and displacement of the activated gripping element 18 on the basis of a given position of a drying aggregate, and with the starting point in the receipt of position signals from the scanning units in connection with the actuators, and signals from the detection unit (if such a unit is provided in the actual embodiment), the device can perform a complete or partial emptying/filling of the drying aggregate's surface 6 with upstanding expansion boards 8 with or without tanned pelts, or tanned, dried pelts, to/from one or more previously disposed receiving points/transport means 14, storage or transfer means 12, 10, or from these and back to the drying aggregate 4, within the area of action of the gripping element.

Without renouncing the right to embodiments with other types of actuators, it is noted that it is preferred that the first, second, fifth and sixth actuators 16, 23, 50, 60 comprise pneumatic pistons.

Without renouncing the right to embodiments with other types of actuators, it is noted that it is preferred that the third and fourth actuator 36, 40, respectively, be comprised of a first and a second angle-gear motor. The device 2 can be used in connection with different arrangements of fur producing equipment, as shown in FIG. 5, or together with a specially arranged transport system 14, as indicated in FIG. 6, intended for internal transport between the different fur production machines.

In FIG. 5, the device is shown in an arrangement having a pelt remover 70 for the automatic/mechanical removal of the dried pelts from the upstanding expansion boards 8 after these have been placed by the device 2 according to the invention in a circular transfer unit 10 which, after removal of the pelt, the holding bag and the pelt board inner bag, by the transfer unit 10 is turned to a bag mounting unit 72 where the respective expansion board 8 is provided with a pelt board inner bag, after which it is transferred to a circular storage unit 74 for non-dried pelts which are ready for the tanning on a tanning machine (not shown), the expansion boards with the tanned pelts being placed back in the circular storage unit 74 after tanning, from which, with the device 2 according to the invention, they are fed back to the drying aggregate 4 in the upstanding position, and placed in this position in the drying aggregate's surface 6 by the blunt element 80 extending from the lower end 78 of the pelt board being engaged in the openings 76.

In FIG. 6, the device 2 according to the invention is shown during the transfer of expansion pelt boards 8 between a drying aggregate 4 and an internal transport system 14 which comprises a rail system 82 on which a number of self-propelled transport carriages 84 are placed, and which are arranged for transport of the expansion boards 8 in upstanding position between various fur production machines (not shown). These fur production machines could, for example, comprise a pelt remover 70 and the bag mounting unit for the mounting of new pelt board inner bags on the board, and a tanning machine (not shown) where a respective expansion board with a tanned pelt turns back to a reference point/collection point within the area of operation for the device 2 according to the invention, after which the expansion board with the tanned pelt is transferred to the surface of the drying aggregate, and immediately afterwards a pelt board with dried pelt is transferred from the drying aggregate to the relevant transport carriage, and hereafter released for transport.

Thus, with the device 2 according to the invention, there is provided a fully automatic handling unit which renders superfluous all manual work with the handling of expansion boards between the various machines which are involved in a modern production of furs.

What is claimed is:

1. Device for performing a complete or partial emptying/filling of a drying aggregate with upstanding expansion pelt boards with respect to one or more suitable receiving stations for further transport and/or handling, comprising:

a first actuator which is vertically displaceable between an upper and a lower outer position, a displaceable support arm carrying said first actuator on a free end thereof, a second actuator which is mounted to the first actuator, a gripping element mounted for vertical displacement by the first actuator and comprising a first plate-shaped movable part and a second plate-shaped movable part, the plate-shaped movable parts being mounted for pivoting movement about vertical axes and being actuated by said second actuator for gripping and releasing an upstanding expansion pelt board, a third actuator for moving the displaceable support arm in a first direction, a fourth actuator, a carriage displaceable by the fourth actuator, and a guide rail on which the carriage is displaceably mounted, wherein the support arm is arranged on the carriage so as to be displaceable with the carriage in a second direction by the fourth actuator.

2. Device according to claim 1, wherein a fifth actuator is connected to the gripping element in manner for pivoting the gripping element between a first collection/delivery position and a second collection/delivery position which is turned at an angle in relation to the first position.

3. Device according to claim 2, wherein the guide rail is mounted on brackets secured to a fixed underlayer.

4. Device according to claim 3, further comprising a locking mechanism having first and second parts, the first part of the locking mechanism being activatable by a sixth actuator which cooperates with the second part of the locking mechanism which is mounted on a wheel-mounted drying aggregate for correct positioning and securing of the drying aggregate during removal of expansion pelt boards from or the placing of expansion pelt boards on a surface of the drying aggregate.

5. Device according to claim 4, further comprising a control unit arranged for controlling movement and displacement of the gripping element from a given position relative to the drying aggregate; wherein each of the first, second, third, fourth, fifth and sixth actuators has a corresponding scanning unit/signal generator for transmitting a signal indicative of the position of the respective actuator to the control unit.

6. Device according to claim 5, wherein the gripping element comprises a signal-generating detection unit for detecting upstanding expansion pelt boards on the drying aggregate, the signal-generating detection unit being fastened and positioned by the locking mechanism and transmitting signals to the control unit.

7. Device according to claim 6, wherein control unit is operable for the performing of a complete or partial emptying/filling of the surface of the drying aggregate to/from one or more previously arranged receiving points, transport, storage or transfer means within an area of action of the gripping element based upon a starting point based on position signals received from the scanning units and signals from the detection unit.

8. Device according to claim 7, wherein the first, second, fifth and sixth actuators comprise pneumatic pistons.

9. Device according to claim 7, wherein the third and fourth actuators comprise first and second angle-gear motors.

10. Device according to claim 1, wherein a free end of each of the first and second plate-shaped movable parts has a flange that is bent inwards towards an oppositely-facing side of the other of the first and second plate-shaped movable parts facilitate securing of an expansion pelt board between the first and second plate-shaped movable parts.

* * * * *